US005114607A

United States Patent [19]

Deck et al.

[11] Patent Number: 5,114,607

[45] Date of Patent: May 19, 1992

[54] LOW FOAMING ALKALINE CLEANER COMPRISING A SURFACTANT MIXTURE OF AN EO-PO-EO BLOCK COPOLYMER AND A PO-ZO-PO BLOCK COPOLYMER

[75] Inventors: Philip D. Deck, Ardsley; Jose B. Rivera, Philadelphia; William L. Harpel, Langhorne, all of Pa.

[73] Assignee: Betz Laboratories, Inc., Trevose, Pa.

[21] Appl. No.: 565,287

[22] Filed: Aug. 8, 1990

[51] Int. Cl.[5] ..... C11D 7/06; C11D 1/66

[52] U.S. Cl. ..... 252/156; 252/174.22; 252/174.21; 252/135; 252/173; 252/DIG. 14

[58] Field of Search ..... 252/135, 156, 173, 174.21, 252/174.22, DIG. 14

[56] References Cited

U.S. PATENT DOCUMENTS

| | | | |
|---|---|---|---|
| 2,650,875 | 9/1953 | Dvorkovitz | 41/42 |
| 2,882,134 | 4/1959 | Spring et al. | 41/42 |
| 3,882,038 | 5/1975 | Clayton et al. | 252/174.22 |
| 4,094,701 | 9/1991 | Fekete | 252/85 |
| 4,332,692 | 6/1982 | Dayne et al. | 252/174.22 |
| 4,410,447 | 10/1983 | Decker et al. | 252/174.22 |
| 4,452,712 | 6/1984 | Laemmle | 252/52 A |
| 4,477,290 | 10/1984 | Carroll et al. | 148/6 |
| 4,521,332 | 6/1985 | Milora | 252/527 |
| 4,588,516 | 5/1986 | Schwartz | 252/174.22 |
| 4,599,116 | 7/1986 | King et al. | 134/40 |
| 4,756,846 | 7/1988 | Matsuura et al. | 252/173 |
| 4,762,638 | 8/1988 | Dollman et al. | 134/40 |
| 4,836,951 | 6/1989 | Totten et al. | 252/174.21 |
| 5,049,303 | 9/1991 | Secenski | 252/174.22 |

*Primary Examiner*—Paul Lieberman
*Assistant Examiner*—Bradley A. Swope
*Attorney, Agent, or Firm*—Alexander D. Ricci; Steven D. Boyd

[57] ABSTRACT

A cleaning and etching solution and method for metal surface is disclosed which is an alkaline formulation which includes a surfactant combination of a low foaming ethylene oxide - propylene oxide block copolymer surfactant and a defoaming reverse ethylene oxide - propylene oxide block copolymer. The preferred cleaner includes an alkali metal hydroxide, an alkali metal salt of gluconic acid and preferably an alkali tripolyphosphate and the surfactant combination.

3 Claims, No Drawings

LOW FOAMING ALKALINE CLEANER COMPRISING A SURFACTANT MIXTURE OF AN EO-PO-EO BLOCK COPOLYMER AND A PO-ZO-PO BLOCK COPOLYMER

FIELD OF THE INVENTION

The present invention relates to the cleaning and etching of metal surfaces to remove dirt, debris, oil and fine metal particles. More particularly, the present invention pertains to alkaline cleaning and etching formulations for metals in which a surfactant combination of a low foaming ethylene oxide - propylene oxide block copolymer surfactant and a defoaming reverse ethylene oxide - propylene oxide block copolymer surfactant are employed.

BACKGROUND OF THE INVENTION

Alkaline cleaning treatments are employed in a variety of metal forming and coating processes. In the production of steel, cleaning operations to remove oil and debris take place prior to annealing, galvanizing, plating or coating. In aluminum processing, cleaning operations to remove oil and debris precede conversion coating or other coating operations. Satisfactory treatment of such metals requires that any dirt and lubricants from the forming, drawing and ironing operations be removed. Alkaline and acid cleaners are employed in the metal cleaning area. In the cleaning of aluminum, both alkaline and acid cleaners have been employed. Acid etching and cleaning with, for example, hydrofluoric acid gives good results producing clean mirror bright surfaces. However, the use of acids for cleaning present safety and effluent disposal problems and also requires stainless steel equipment. For these reasons, alkaline cleaning and etching processes are favored in the aluminum processing industry. An alkaline cleaning and etching process for aluminum is disclosed in U.S. Pat. No. 4,477,290 to Carroll et. al. The low temperature alkaline cleaning and etching solution for aluminum disclosed comprises alkaline metal hydroxides and a chelating agent at temperatures of from 80 to 130° F. No other ingredients such as wetting agents which would cause foaming problems are required.

U.S. Pat. No. 4,521,332 to Milora discloses a highly alkaline aqueous cleaning dispersion for strip steel which comprises sodium hydroxide, a bulking agent such as sodium carbonate and a poly(acrylic acid) dispersing agent.

With prior art cleaning solutions, the accumulation of oils in the bath presents a three fold problem. First, the presence of oils makes metal cleaning more difficult as the capacity of the surfactants to emulsify oil from the metal becomes limited. Second, in alkaline baths, the oils may saponify and thereby contribute to foaming. Third, subsequent treatment of the affluent must separate out the emulsified oils prior to discharge. Higher treatment levels of surfactants are often used to remedy the problems of insufficient cleaning in the presence of oils. However, this may result in an increase in foam generation and difficulties in breaking the oil/water emulsion prior to discharge of the effluent.

SUMMARY OF THE INVENTION

The present invention provides a composition and method for cleaning metal surfaces such as aluminum, cold rolled steel, galvanized steel and Galvalume (a trademark of the Bethlehem Steel Corporation). The present invention effectively removes dirt, debris, oil and fine metal particles from the metal surface. The present invention is notably effective under heavy oil contamination loads without excessive foaming or waste treatment/handling problems. The present invention comprises the addition of a low foaming ethylene oxide - propylene oxide (EO-PO) block copolymer surfactant and a defoaming reverse EO-PO block copolymer surfactant to a cleaner comprising an alkali metal hydroxide, an alkali metal salt of gluconic acid and preferably an alkali metal tripolyphosphate. Both surfactants effectively wet a metal surface being cleaned. The water soluble surfactant provides detergency while the oil soluble surfactant acts as a defoamer and aids in separation of the oil during waste fluid treatment.

The composition of the present invention may be in the form of a powder or an aqueous suspension. The aqueous solution will include a hydrotrope to maintain the suspension. The method and composition of the present invention provides for effective cleaning of metal surfaces even under heavy oil conditions due to the presence of the low foaming EO-PO block copolymer surfactant. The cleaning bath is resistant to foaming due to the presence of the defoaming reverse EO-PO block copolymer surfactant. In addition, the defoaming reverse EO-PO surfactant simplifies separation of the waste oils from the aqueous treatment solution during effluent treatment.

DESCRIPTION OF THE PREFERRED EMBODIMENTS

The present invention is directed to a composition and method for use in cleaning and etching of metal surfaces. The cleaning solution of the present invention preferably includes an alkali metal hydroxide, an alkali metal salt of gluconic acid and preferably an alkali metal tripolyphosphate. It was discovered that the addition of a unique surfactant combination comprising a low foaming EO-PO block copolymer surfactant and a defoaming reverse EO-PO block copolymer surfactant will provide for lower surface tension thereby enhancing cleaning while also controlling foaming in the cleaning solution. The components of the surfactant combination are copolymer surfactants of the general formula: $(RO)—(R'O)_n—(RO)$ for an EO-PO block copolymer and $(R'O)—(RO)_n—(R'O)$ for a reverse EO-PO block copolymer where R equals an ethylene group and R' is a propylene group and n is at least 5. The ratio of the EO-PO surfactant to the reverse EO-PO surfactant as well as the selection of specific commercial surfactants will be related to the specific properties of the system being treated.

The cleaning solution of the present invention may optionally include an alkali metal tripolyphosphate. Preferably sodium tripolyphosphate is employed. Because of the concerns relating to phosphate discharge, "non-phosphate" cleaning and etching solutions are desirable in some areas. A "non-phosphate" cleaner in accordance with the present invention would require the selection of and balancing of ratios of the EO:PO surfactants to reverse EO:PO surfactants unique to such a system. For example, the ratio of EO:PO to reverse EO:PO surfactant may need to be increased or, alternatively, surfactant of higher HLB values may need to be employed to increase the cleaners detergency. Additional sequesterants may also be necessary.

The composition of the present invention may be supplied as a powder or as an aqueous solution. Typically, when supplied as an aqueous solution, the solution is a concentrate which is diluted in water to 1 to 6% by volume prior to use. When formulated as an aqueous solution, the composition includes a hydrotrope which increases the aqueous solubility of the surfactants. Suitable hydrotropes include sodium alkanoate such as Monatrope 1250 available from Mona Industries. A preferred aqueous concentration in accordance with the present invention comprises in volume percent:

| Ingredient | Concentration |
|---|---|
| Water | 55 to 65% |
| KOH (45%) | 20 to 30% |
| Sodium tripolyphosphate | 3 to 10% |
| Gluconic acid (50%) | 2 to 5% |
| Monotrop 1250 | 3 to 10% |
| Pluronic L-43 and Pluronic 31R-1 | 0.5 to 3% |

Such a concentrate would be diluted to approximately 1 to 6% in water, preferably 3% prior to use. Pluronic L-43 is a low foaming EO-PO block copolymer surfactant while Pluronic 31R-1 is a defoaming reverse EO-PO block copolymer surfactant. Both are available from BASF-Wyandotte Corporation. The Pluronic block copolymers are nonionic difunctional block polymers. They are polyoxyalkaline derivatives of polyethylene glycol. The selection of the ratio of low foaming to defoaming surfactant will depend upon the specific conditions of the system being treated. Typically the ratio will range from about 1:3 to 3:1. The concentration of the hydrotrope may have to be adjusted based on the ratio of surfactant to maintain aqueous solubility.

The present invention will now be further described with reference to a number of specific examples which are to be regarded solely as illustrative and not as restricting the scope of the invention.

EXAMPLES

Determinations of cleaning efficacy, foaming propensity and waste treatability for a number of cleaning and etching solutions, including the preferred composition of the present invention were undertaken. Cleaning efficacy was determined by estimating the percentage of water break free (% WBF) surface on aluminum, cold rolled steel, and hot-dipped galvanized steel. The solution was spray applied at 125° F. for 5 seconds on aluminum and galvanized steel and 10 seconds on cold rolled steel. The free alkalinity of the treatment solution in points was as shown. Foaming propensity was determined by measuring the foam height after 5 minutes bath circulation at 125° F. and 15 psi. Waste treatability was determined by measuring the clarity of a column of the waste effluent in a graduated cylinder. The volume in Table 3 is a minimum volume through which a mark on the bottom of a graduated cylinder could be viewed.

Table 1 summarizes a cleaning efficacy of A: the preferred composition of the present invention as described above; B: a composition comprising sodium hydroxide, sodium tripolyphosphate, soda ash, sodium gluconate, and a high ratio of Tergitol TMN-3 to Tergitol TMN-6; C: a composition comprising potassium hydroxide, sodium tripolyphosphate, gluconic acid, Triton DF-20, and a low ratio of Tergitol TMN-3 to Tergitol TMN-6; D: a composition comprising sodium hydroxide, soda ash, sodium tripolyphosphate, trisdoium phosphate, Plurafac D-25, Plurafac RA-20, Tergitol MinFoam 1-X, and Triton CF-76; E: Parco 8001 available from Parker-Amchem (Henkel Corp.) phosphated, alkaline cleaner with ethoxylated surfactants. Tergitol is a tradename for a series of nonionic and anionic surfactants available from Union Carbide Corp. Triton is a tradename for modified ethoxylated surfactants available from Rohm & Haas Co.

TABLE 1

| | Cleaning Efficacy (% WBF on CRS) | | | |
|---|---|---|---|---|
| | Free | % Oil | | |
| Treatment | Alkalinity | 0.0 | 0.5 | 1.0 |
| A | 11.0 | 100 | 100 | 100 |
| B | 12.4 | 99 | 95 | 85 |
| C | 12.9 | 100 | 100 | 99 |
| D | 10.1 | 100 | 95 | 80 |
| E | 12.9 | 99 | 85 | 15 |

Table 2 summarizes foam height measurements for the same compositions as in Table 1.

TABLE 2

| | Foaming Propensity (height in cm) | |
|---|---|---|
| | % Oil | |
| Treatment | 0.0 | 2.0 |
| A | 0.0 | 0.0 |
| B | 0.0 | 2.5 |
| C | 1.0 | 14.0 |
| D | 0.4 | 1.0 |
| E | 0.4 | 2.0 |

Table 3 summarizes the results of the waste treatability studies of the composition as in Table 1 in terms of clarity, oil recovery (parts per million) after acidification and oil recovery in parts per million after acidification and lime plus flocculant treatment. Both acidification and acidification plus lime/flocculant are known waste effluent cleaning operations.

TABLE 3

| | Waste Treatability Oil (ppm) | | |
|---|---|---|---|
| Treatment | Acidification | Acidification + Lime/flocculant | Clarity (ml) |
| A | — | — | 44 |
| B | 192 | 100 | 26 |
| C | 496 | 101 | 14 |
| D | 3980 | 1530 | 11 |
| E | 284 | 40 | 15 |

As can be seen from Table 1, 2 and 3, the preferred composition (A) of the present invention provides improved cleaning efficacy, with a low foaming propensity and acceptable waste treatability. Treatments of the prior art, B, C, D and E all exhibit a pronounced weakness in at least one of these areas.

While this invention has been described with respect to particular embodiments thereof, it is apparent that numerous other forms and modifications of the invention will be obvious to the skills of the art. The appended claims and this invention generally should be construed to cover all such obvious forms and modifications which are within the true spirit and scope of the present invention.

What is claimed is:

1. A cleaning solution for cleaning and etching a metal surface with an alkali treatment including an alkali metal hydroxide and an alkali metal salt of gluconic acid, the improvement comprising including in said cleaning solution the combination of a low foaming ethylene oxide - propylene oxide block copolymer surfactant of the structure (RO)—(R'O)$_n$—(RO) and a defoaming reverse ethylene oxide - propylene oxide block copolymer surfactant of the structure (R'O)—(-RO)$_n$—(R'O) as the sole foam agents where R is ethylene and R' is propylene; wherein the ratio of ethylene oxide - propylene oxide block copolymer to reverse ethylene oxide - propylene oxide block copolymer is from about 1 to 3 to about 3 to 1; and wherein the concentration of ethylene oxide - propylene oxide block copolymer surfactant and reverse ethylene oxide - propylene oxide block copolymer surfactant in the cleaning solution ranges from about 0.005 to about 0.18 volume percent.

2. A method of cleaning and etching a metal surface with an alkaline cleaning solution comprising an alkali metal hydroxide and an alkali metal salt of gluconic acid, the improvement comprising including in said solution the combination of a low foaming ethylene oxide - propylene oxide block copolymer surfactant of the structure (RO)—)R'O)$_n$—(RO) and a defoaming reverse ethylene oxide - propylene oxide block copolymer surfactant of the structure (R'O)—(RO)$_n$—(R'O) as the sole foam agents where R is ethylene and R' is propylene; wherein the ratio of ethylene oxide - propylene oxide block copolymer to reverse ethylene oxide - propylene oxide block copolymer is from about 1 to 3 to about 3 to 1; and wherein the concentration of ethylene oxide - propylene oxide block copolymer surfactant and reverse ethylene oxide - propylene oxide block copolymer surfactant in the cleaning solution ranges from about 0.005 to about 0.18 volume percent.

3. A composition for cleaning and etching a metal surface comprising an alkali metal hydroxide, an alkali metal tripolyphosphate salt, an alkali metal salt of gluconic acid and a surfactant combination comprising a low foaming ethylene oxide - propylene oxide block copolymer surfactant of the structure (RO)—(R'O)-$_n$—(RO) and a defoaming reverse ethylene oxide - propylene oxide block copolymer surfactant of the structure (R'O)—(RO)$_n$—(R'O) as the sole foam agents where R is ethylene and R' is propylene; wherein the ratio of ethylene oxide - propylene oxide block copolymer to reverse ethylene oxide - propylene oxide block copolymer is from about 1 to 3 to about 3 to 1; and wherein the concentration of ethylene oxide - propylene oxide block copolymer surfactant and reverse ethylene oxide - propylene oxide block copolymer surfactant in the cleaning solution ranges from about 0.005 to about 0.18 volume percent.

* * * * *